US005998714A

United States Patent [19]

McNamara, Jr.

[11] Patent Number: 5,998,714

[45] Date of Patent: Dec. 7, 1999

[54] TONAL COMPENSATOR SYSTEM FOR THE FRETBOARDS OF STRINGED INSTRUMENTS

[76] Inventor: Thomas J. McNamara, Jr., 1220 Leonard Ave., Pasadena, Calif. 91107

[21] Appl. No.: 08/951,624

[22] Filed: Oct. 16, 1997

[51] Int. Cl.[6] ..... G10D 3/06

[52] U.S. Cl. ..... 84/314 R

[58] Field of Search ..... 84/314 R, 312 R

[56] References Cited

U.S. PATENT DOCUMENTS 4,064,779 12/1977 Petillo ..... 84/314 R

*Primary Examiner*—William M. Shoop, Jr.
*Assistant Examiner*—Shih-yung Hsien

[57] ABSTRACT

A compensator system for a stringed instrument is disclosed. The system includes a plurality of compensator blocks selectively positionable on the fretboard of a stringed instrument between its transverse projections. The compensator blocks extend upwardly in contact with the strings of the instrument. The blocks have a generally rectangular lower planar surface of a first length and first width and an upper planar surface of a second length and a second width. The width of the upper surface of the blocks is less than the width of the lower surface of the blocks thus forming tapered side walls between the upper and lower surfaces to form a trapezoidally-shaped cross-sectional configuration. The length of the lower surface of each block is essentially equal to the length of the fretboard between adjacent projections of the instrument.

7 Claims, 2 Drawing Sheets

TONAL COMPENSATOR SYSTEM FOR THE FRETBOARDS OF STRINGED INSTRUMENTS

BACKGROUND OF THE INVENTION

1. Field of the Invention

The present invention relates to a new and improved tonal compensator system for the fretboards of stringed instruments and, more particularly, pertains to improving the sound of a stringed instrument through the use of tonal compensators.

2. Description of the Prior Art

The use of stringed instruments of various designs and configurations is known in the prior art. More specifically, stringed instruments of various designs and configurations heretofore devised and utilized for the purpose of modifying the sound of stringed instruments through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of stringed instruments of various designs and configurations. By way of example, U.S. Pat. No. 4,064,779 to Petillo discloses a substantially T-shaped fret with an elongated stem topped by a triangularly shaped cap.

U.S. Pat. No. 4,132,143 to Stone discloses a fretted musical instrument with detachable fingerboard for providing multiple tonal scales.

U.S. Pat. No. 4,363,256 to Smith discloses a manual, mechanical chord or note selecting device mounted on a fretted, stringed musical instrument with a convenient leverage means for faster, easier keying.

U.S. Pat. No. 4,633,754 to Chapman discloses a fret rod for stringed musical instruments with transverse, shallow U-shape grooves which receive circular metal fret rods which provides an improved playing surface.

U.S. Pat. No. 4,723,469 to Vogt discloses a fret for the fingerboard of plucked stringed instruments comprising a metal body including on its side facing the string a structural groove extending parallel to the longitudinal axis of the fret whereby an insert is placed against which the fingered string presses slightly so as to be held stationarily.

Lastly, U.S. Des. Pat. No. 264,477 to Brent discloses a guitar fretboard or the like.

In this respect, the tonal compensator system for the fretboards of stringed instruments according to the present invention substantially departs from the conventional concepts and designs of the prior art, and in doing so provides an apparatus primarily developed for the purpose of improving the sound of a stringed instrument through the use of tonal compensators.

Therefore, it can be appreciated that there exists a continuing need for a new and improved tonal compensator system for the fretboards of stringed instruments which can be used for improving the sound of a stringed instrument through the use of tonal compensators. In this regard, the present invention substantially fulfills this need.

SUMMARY OF THE INVENTION

In view of the foregoing disadvantages inherent in the known types of stringed instruments of various designs and configurations now present in the prior art, the present invention provides a new and improved tonal compensator system for the fretboards of stringed instruments. As such, the general purpose of the present invention, which will be described subsequently in greater detail, is to provide a new and improved tonal compensator system for the fretboards of stringed instruments and methods which have all the advantages of the prior art and none of the disadvantages.

To attain this, the present invention essentially comprises a new and improved tonal compensator system for the fretboards of stringed instruments comprising, in combination, an instrument having a fretboard and parallel strings secured adjacent thereto at an essentially common spacing therebetween. The fretboard has transverse linear projections extending upwardly from the fretboard toward the strings at spaced locations along the length thereof to define spaced touch sections of the strings. A plurality of compensator blocks are selectively positioned on the fretboard between the transverse projections and extending upwardly in contact with the strings. The blocks have a generally rectangular lower planar surface of a first length and first width and with an upper planar surface of a second length and a second width. The length of the lower surface of the blocks is essentially the same as the length of the upper surface. However, the width of the upper surface of the blocks is less than the width of the lower surface of the blocks, thus forming tapered side walls between the upper and lower surfaces which create a trapezoidally-shaped cross-sectional configuration. The length of each block is essentially equal to the length of the fretboard between adjacent projections. An adhesive is provided for placement between each block and the adjacent portion of the fretboard for the coupling therebetween.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tonal compensator system for the fretboards of stringed instruments which has all the advantages of the prior art stringed instruments of various designs and configurations and none of the disadvantages.

It is another object of the present invention to provide a new and improved tonal compensator system for the fretboards of stringed instruments which may be easily and efficiently manufactured and marketed.

It is a further object of the present invention to provide a new and improved tonal compensator system for the fretboards of stringed instruments which is of a durable and reliable construction.

An even further object of the present invention is to provide a new and improved tonal compensator system for the fretboards of stringed instruments which is susceptible of a low cost of manufacture with regard to both materials and labor, and which accordingly is then susceptible of low prices of sale to the consuming public, thereby making such a tonal compensator system for the fretboards of stringed instruments economically available to the buying public.

Even still another object of the present invention is to improve the sound of a stringed instrument through the use of tonal compensators.

Lastly, it is an object of the present invention to provide a compensator system for a stringed instruments. The system includes a plurality of compensator blocks selectively positionable on the fretboard of a stringed instrument between its transverse projections. The compensator blocks extend upwardly in contact with the strings of the instrument. The blocks have a generally rectangular lower planar surface of a first length and first width and an upper planar surface of a second length and a second width. The width of the upper surface of the blocks is less than the width of the lower surface of the blocks thus forming tapered side walls between the upper and lower surfaces to form a trapezoidally-shaped cross-sectional configuration. The length of the lower surface of each block is essentially equal to the length of the fretboard between adjacent projections of the instrument.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
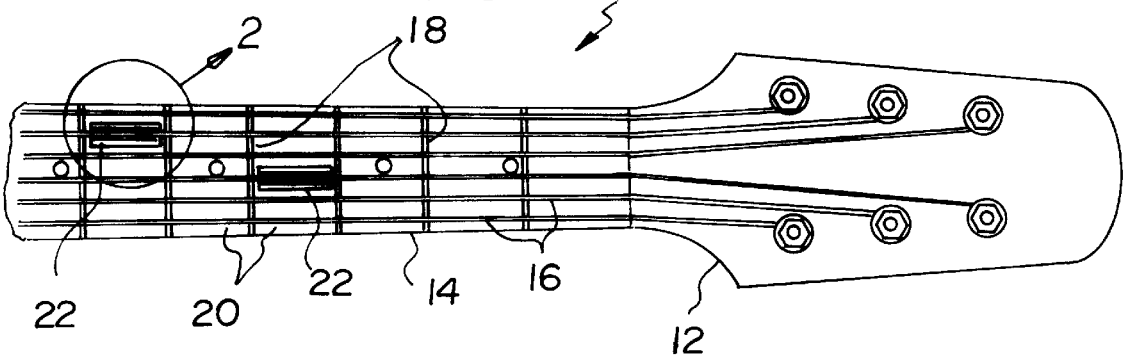
FIG. 1 is a top plan view of the preferred embodiment of the tonal compensator system for the fretboards of stringed instruments constructed in accordance with the primary embodiment of the present invention.
Figure 2:
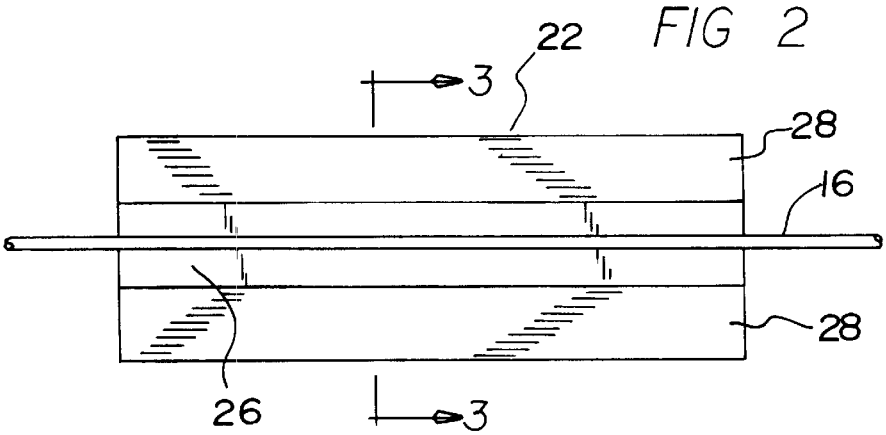
FIG. 2 is an enlarged showing of a portion of the system showing FIG. 1 taken at circle 2 of FIG. 1.
Figure 3:
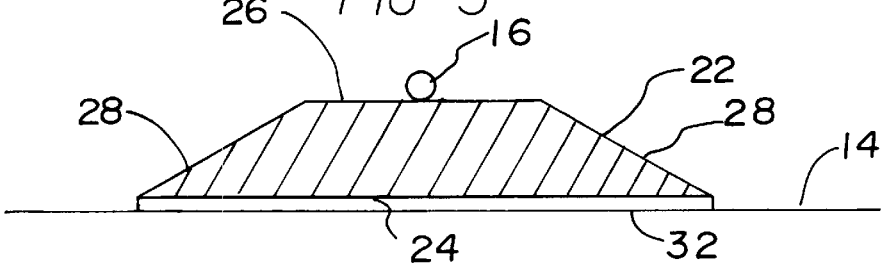
FIG. 3 is a cross-sectional view taken along line 3—3 of FIG. 2.
Figure 4:
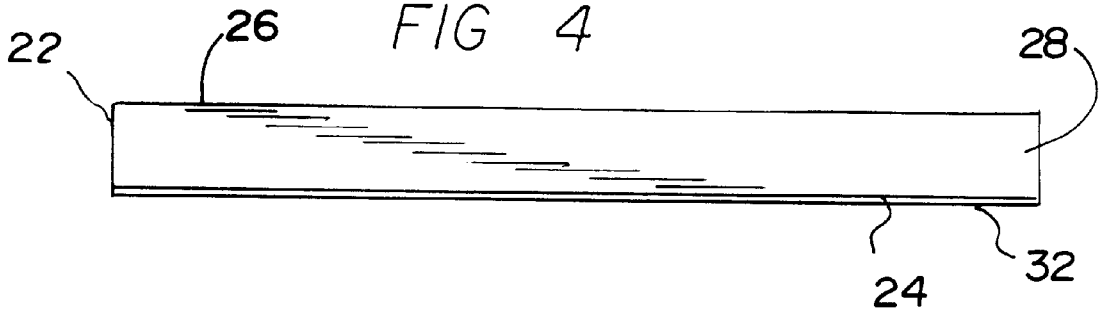
FIG. 4 is a side elevational view of the block shown in FIGS. 1 through 3.

With reference now to the drawings, and in particular to FIGS. 1 through 6 thereof, the preferred embodiment of the new and improved tonal compensator system for the fretboards of stringed instruments embodying the principles and concepts of the present invention and generally designated by the reference numeral 10 will be described.

The present invention is a new and improved system 10, a compensator system for the fretboards of stringed instruments such as a guitar. The system 10 includes the musical instrument itself 12. Such musical instrument is of the type having a fretboard 14 and parallel strings 16. The strings are located adjacent to the fretboard in an essentially common plane with an essentially common spacing from string to string and an essentially common spacing between the strings and the fretboard. The fretboard is of the type having transverse linear projections 18. Such projections extend upwardly from the fretboard a short distance toward the strings. The projections are at spaced locations along the length of the fretboard and define therebetween various touch sections 20 of the strings and fretboard.

Next provided are a plurality of compensator blocks 22. The blocks are selectively positioned on the fretboard between the transverse projections. The blocks extend upwardly from the fretboard into contact with the strings to modify their tonal response to being strummed. The blocks have a generally rectangular lower planar surface 24. Such blocks have a first length and a first width on the lower face. The blocks also have an upper planar surface 26. The upper planar surface is of a second length and of a second width. The length of the lower surface of the blocks is essentially equal to the length of the upper surface of the blocks. Further, the width of the upper surface of the blocks is preferably less than the width of the lower surface of the blocks. As such, tapered side walls 28 are formed between the upper and lower surfaces of the block. This forms an essentially trapezoidal shaped cross-sectional configuration to the block. The length of each block is essentially equal to the length of the fretboard between adjacent projections.

Lastly provided to the system is an adhesive 32. The adhesive is located between each block and the adjacent portion of the fretboard. The adhesive functions to couple the lower surface of the block to the fretboard in a proper orientation.

Figure 5:
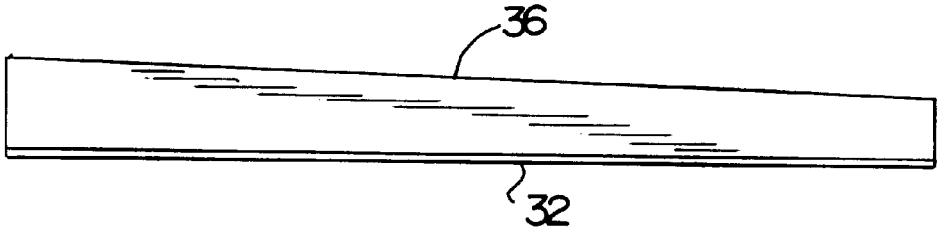
FIG. 5 is a side elevational view similar to FIG. 4 but illustrating an alternate embodiment of the invention.

As can be seen in FIG. 5, an alternate embodiment of the invention is provided. In such alternate embodiment, the upper surface 36 is not parallel with the lower surface 32 as in the embodiment of FIGS. 1 through 4, the primary embodiment. In the alternate embodiment of FIG. 5, the upper surface 36 is at a slight angle of between about two and five degrees with respect to the lower surface. Such a configuration will allow the entire length of the string to be in contact with the upper surface of the fretboard for a further variation in the sound generated by the string of the stringed instrument when strummed.

Figure 6:
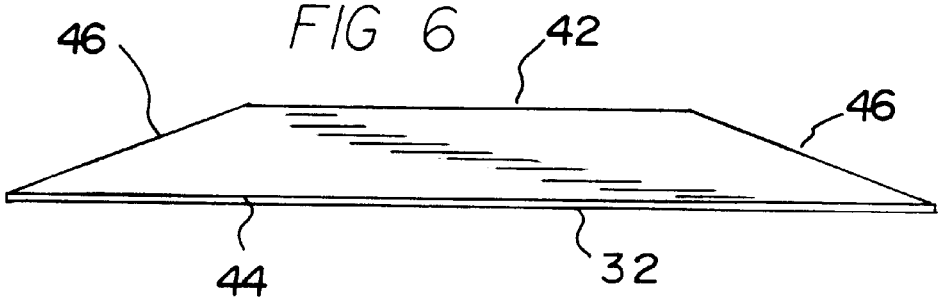
FIG. 6 is a view similar to FIGS. 4 and 5 but illustrating another alternate embodiment of the invention.

The FIG. 6 embodiment is similar to that of FIGS. 1 through 4 but has a further variation. In such further variation, the upper surface 42 of the fretboard is of a length less than the length of the lower surface 44 and less than the length of the fretboard between adjacent projections. In the FIG. 6 embodiment, the length of the block has an upper length equal to between about 40 and 60 percent of the lower length. In addition, angled side portions 46 are formed to couple the upper and lower surfaces of the block. Such a shaped block will again vary the tone provided by the strings of the instrument when strummed as a function of the length of the upper surface of the block.

The present invention, in any of its disclosed embodiments hereinabove, is preferably fabricated of a relatively hard material such as a block of nylon. Acceptable nylons are those manufactured by Dunlop Manufacturing, Inc., under the trademark "Tortex" or by D'Andrea, Inc. An alternate material is "Graphite" as manufactured by Adamas, Inc. Other alternate materials include hard plastic or hard rubber, natural or synthetic blends thereof.

The present invention is a device to correct or minimize certain intonation inaccuracies occurring with acoustic and electric guitars and other similar stringed musical instruments that require fretting in order to change note tones. The present invention, when applied to the fretboard of a stringed instrument as described above, causes the device string to intone flatter at that fret than it would without the present invention. When sharpness is the intonation problem, this device can minimize or eliminate that sharpness thus producing an intonation more in tune.

Many stringed instruments have intonation discrepancies, even after being traditionally adjusted. The present device can help bring the instrument closer to "in tune" anywhere on the neck of the instrument where sharpness is present. The cause of the sharpness can be mechanical, construction or musician technique. The present invention solves certain problems not correctable using all traditional methods. It can solve some problems less expensively by avoiding major or technician required adjustments. It is a very inexpensive device to manufacture. The present invention will ultimately help produce an instrument that plays more in tune.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. A tonal compensator system for the fretboards of stringed instruments having a fretboard and parallel strings secured adjacent thereto at an essentially common spacing therebetween, the fretboard having transverse linear projections extending upwardly from the fretboard toward the strings at spaced locations along the length thereof to define spaced touch sections of the strings;

a plurality of nylon compensator blocks selectively positioned on the fretboard between the transverse projections and extending upwardly in contact with the strings, the blocks having a generally rectangular lower planar surface of a first length and first width and with an upper planar surface of a second length and a second width, the length of the lower surface of the blocks being essentially the same as the length of the upper surface and the width of the upper surface of the blocks being less than the width of the lower surface of the blocks and with tapered side walls between the upper and lower surfaces to form a trapezoidally-shaped cross-sectional configuration, the length of each block being essentially equal to the length of the fretboard between adjacent projections; and an adhesive between each block and the adjacent portion of the fretboard for the coupling therebetween.

2. A compensator system for a stringed instrument having a fretboard and parallel strings secured adjacent thereto at an essentially common spacing therebetween, the fretboard having transverse linear projections extending upwardly from the fretboard toward the strings at spaced locations along the length thereof to define spaced touch sections of the strings; said system comprising:

a compensator block selectively positionable on the fretboard of a stringed instrument between said transverse projections and extending upwardly in contact with the strings of the instrument, the block having a generally rectangular lower planar surface of a first length and first width and with an upper planar surface of a second length and a second width, the width of the upper surface of the blocks being less than the width of the lower surface of the blocks and with tapered side walls between the upper and lower surfaces to form a trapezoidally-shaped cross-sectional configuration, the length of the lower surface of each block being essentially equal to the length of the fretboard between said adjacent projections of the instrument.

3. The system as set forth in claim 2 and further including:

an adhesive between each block and the adjacent portion of the fretboard for the coupling therebetween.

4. The system as set forth in claim 2 wherein the length of the upper surface of the block is essentially equal to the length of the lower surface of the block.

5. The system as set forth in claim 2 wherein the upper surface of the block is planar and at an angle of between about two and five degrees from the lower surface of the block.

6. The system as set forth in claim 2 wherein the upper surface of the block has a length of between about 40 and 60 percent of the length of the lower surface of the block with angled surfaces therebetween.

7. The system as set forth in claim 2 wherein the block is fabricated of nylon.

* * * * *